United States Patent [19]

Vogt

[11] 4,236,378

[45] Dec. 2, 1980

[54] SECTORAL COMBUSTOR FOR BURNING LOW-BTU FUEL GAS

[75] Inventor: Robert L. Vogt, Schenectady, N.Y.

[73] Assignee: General Electric Company, Schenectady, N.Y.

[21] Appl. No.: 882,073

[22] Filed: Mar. 1, 1978

[51] Int. Cl.[3] ..... F02C 7/18

[52] U.S. Cl. ..... 60/757; 60/748

[58] Field of Search ..... 60/39.65, 39.66, 39.69 R, 60/39.74 B, 39.46 S, 757, 756, 755, 752

[56] References Cited

U.S. PATENT DOCUMENTS

| | | | |
|---|---|---|---|
| 2,952,126 | 9/1960 | Denise | 60/39.65 |
| 3,044,263 | 7/1962 | Hennig | 60/39.65 |
| 3,420,058 | 1/1969 | Howald et al. | 60/39.66 |
| 3,483,700 | 12/1969 | Ryberg et al. | 60/39.74 B |
| 3,608,309 | 9/1971 | Hill et al. | 60/39.65 |
| 3,670,497 | 6/1972 | Sheldon | 60/39.66 |
| 3,756,020 | 9/1973 | Moskowitz et al. | 60/39.65 |
| 3,973,395 | 8/1976 | Markowski et al. | 60/39.65 |
| 3,990,232 | 11/1976 | Campbell | 60/39.66 |
| 4,104,874 | 8/1978 | Caruel et al. | 60/39.65 |

FOREIGN PATENT DOCUMENTS

| | | | |
|---|---|---|---|
| 1211441 | 2/1966 | Fed. Rep. of Germany | 60/39.65 |
| 328562 | 4/1958 | Switzerland | 60/39.65 |
| 642257 | 8/1950 | United Kingdom | 60/39.65 |
| 704468 | 2/1954 | United Kingdom | 60/39.65 |
| 200964 | 12/1968 | U.S.S.R. | 60/39.65 |

OTHER PUBLICATIONS

"Coal Firing Nears Practical Stage", *The Oil Engine and Gas Turbine,* Jun. 1951, p. 62.

"Gas Turbines Type 9, 11, 13, Development and Performance", *Brown-Boveri Review,* Jan., 1977, pp. 5-11.

"Designing Gas Turbine Hot Parts", *Gas Turbine International,* May-Jun., 1973, pp. 24-28.

*Primary Examiner*—Robert E. Garrett

[57] ABSTRACT

A high-temperature combustor for burning low-BTU coal gas in a gas turbine is disclosed. The combustor includes several separately removable combustion chambers each having an annular sectoral cross section and a double-walled construction permitting separation of stresses due to pressure forces and stresses due to thermal effects. Arrangements are described for air-cooling each combustion chamber using countercurrent convective cooling flow between an outer shell wall and an inner liner wall and using film cooling flow through liner panel grooves and along the inner liner wall surface, and for admitting all coolant flow to the gas path within the inner liner wall. Also described are systems for supplying coal gas, combustion air, and dilution air to the combustion zone, and a liquid fuel nozzle for use during low-load operation. The disclosed combustor is fully air-cooled, requires no transition section to interface with a turbine nozzle, and is operable at firing temperatures of up to 3000° F. or within approximately 300° F. of the adiabatic stoichiometric limit of the coal gas used as fuel.

11 Claims, 12 Drawing Figures

SECTORAL COMBUSTOR FOR BURNING LOW-BTU FUEL GAS

BACKGROUND OF THE INVENTION

The invention disclosed herein was made in the course of, or under, a contract with the United States Department of Energy.

This invention relates to combustors and more particularly to combustors for burning low-BTU fuel gas such as coal gas in a high-temperature gas turbine.

Uncertainties in the cost and availability of petroleum and natural gas, coupled with the abundant supply of coal in countries such as the United States, has resulted in interest in the use of coal-derived, low-heating-value gaseous fuels in gas turbines. One particular application of low-BTU coal gas, i.e., coal gas with heating values of approximately 2500 BTU/lbm as compared with about 22,500 BTU/lbm for natural gas, is in a system wherein a coal gasification plant is integrated with a combined gas turbine/steam turbine cycle apparatus generating base load electrical power.

A combustor for a gas turbine of the system described above, or for any gas turbine powered by low-BTU fuel gas, must meet several requirements. In order to achieve high cycle efficiencies, the low-BTU coal gas combustor must be operable at high firing temperatures, and in particular, at temperatures closer to the maximum flame temperatures attainable for its fuel than combustors fired by high-BTU fuels. The coal gas combustor must also accommodate fuel/air ratios several times those of combustors using conventional fuel gases such as natural gas and should include means to insure thorough mixing of coal gas and air since for a given desired combustor exit temperature, less dilution air can be used to control combustor exit temperature profiles than is available in combustors fired by high-BTU fuels. In addition, the coal gas combustor, as with other gas turbine combustors, should have minimum heat losses and cooling requirements, good flammability and stability characteristics, low emissions, and be easily fabricable and maintainable.

Accordingly, it is an object of the invention to provide a combustor which is operable to burn low-BTU fuel gas as its primary fuel.

It is a further object of the invention to provide an efficient low-BTU coal gas combustor for a gas turbine which is operable to deliver combustion products to a turbine nozzle at temperatures of 2600° F. or greater.

It is an additional object of the invention to provide a combustor which in addition to fulfilling the above objectives, is fully air-cooled, thus requiring no parasitic, externally supplied coolant, and is compact and easily maintainable.

SUMMARY OF THE INVENTION

A combustion chamber is provided for high-temperature burning of low-BTU coal gas in a gas turbine. The combustion chamber, one of several separately removable chambers which may be positioned circumferentially about the gas turbine axis to form a combustor, is of double-walled construction and has an annular sectoral cross-sectional shape. An outer shell wall of the chamber carries essentially all pressure loading during operation and also supports an inner liner wall which in turn carries essentially all of the thermal loads. A coolant channel defined between the walls accommodates a flow of air in countercurrent relationship to combustion flow for convective cooling of the walls. The panels which form the liner wall are provided with grooves to admit a portion of the countercurrent flow to the combustion zone for film cooling of the liner wall inner surface, and means are provided to introduce the remaining portion into the combustion zone near the chamber upstream end as preheated combustion air. Also included as part of the combustion chamber are arrangements for supplying coal gas, additional combustion air, and dilution air to the combustion zone, and a nozzle for furnishing liquid fuel during gas turbine startup and operation at low loads. The annular sectoral combustion chamber of the invention requires no transition section between combustor and a turbine, has walls which are fully air-cooled and of non-flow separable geometry, and is operable at high efficiencies at firing temperatures up to 3000° F.

BRIEF DESCRIPTION OF THE DRAWINGS

While the specification concludes with claims particularly pointing out and distinctly claiming the subject matter regarded as the invention, the invention will be better understood from the following description taken in connection with the accompanying drawings in which:

DETAILED DESCRIPTION OF THE INVENTION

Figure 1:
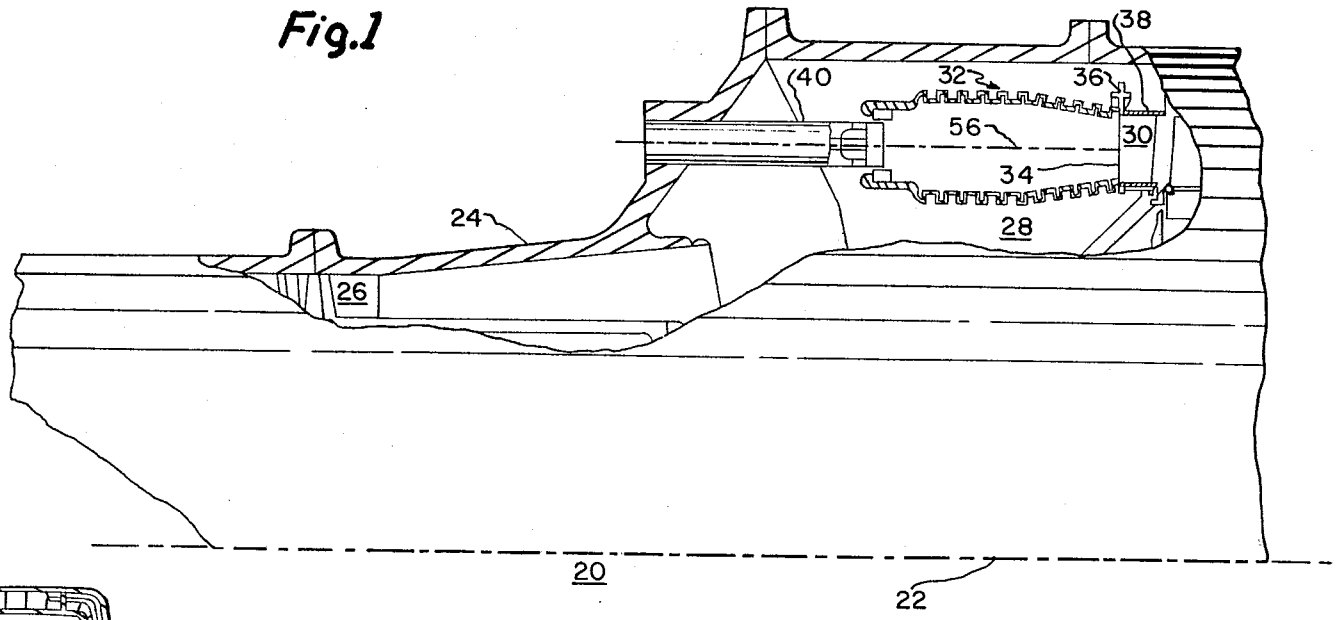
FIG. 1 is a side view of a portion of a gas turbine with sections broken away to expose one of the combustion chambers of a preferred embodiment of the invention.

FIG. 1 shows a portion of a gas turbine 20 which includes the combustor of the invention. Gas turbine 20 is typically of circular cross-section and has a central axis 22 along which are spaced and housed within casing 24 a compressor 26, a combustor 28, and a turbine 30. During operation of gas turbine 20, combustor 28 acts to burn fuel with high-pressure air from compressor 26, adding energy thereto, and a portion of the energy of the hot gases leaving combustor 28 is then extracted in passing through turbine 30, which drives compressor 26 and a suitable load (not shown) such as a power generator.

In a preferred embodiment of the invention, combustor 28 comprises a plurality of combustion chambers such as chamber 32 positioned about axis 22 and located axially immediately upstream of the first stage turbine nozzle 34. Primary structural support for chamber 32 is provided at its downstream end by a bolted flanged connection 36 to the turbine nozzle outer wall 38 and at its upstream end by fuel pipe 40.

Figure 2:
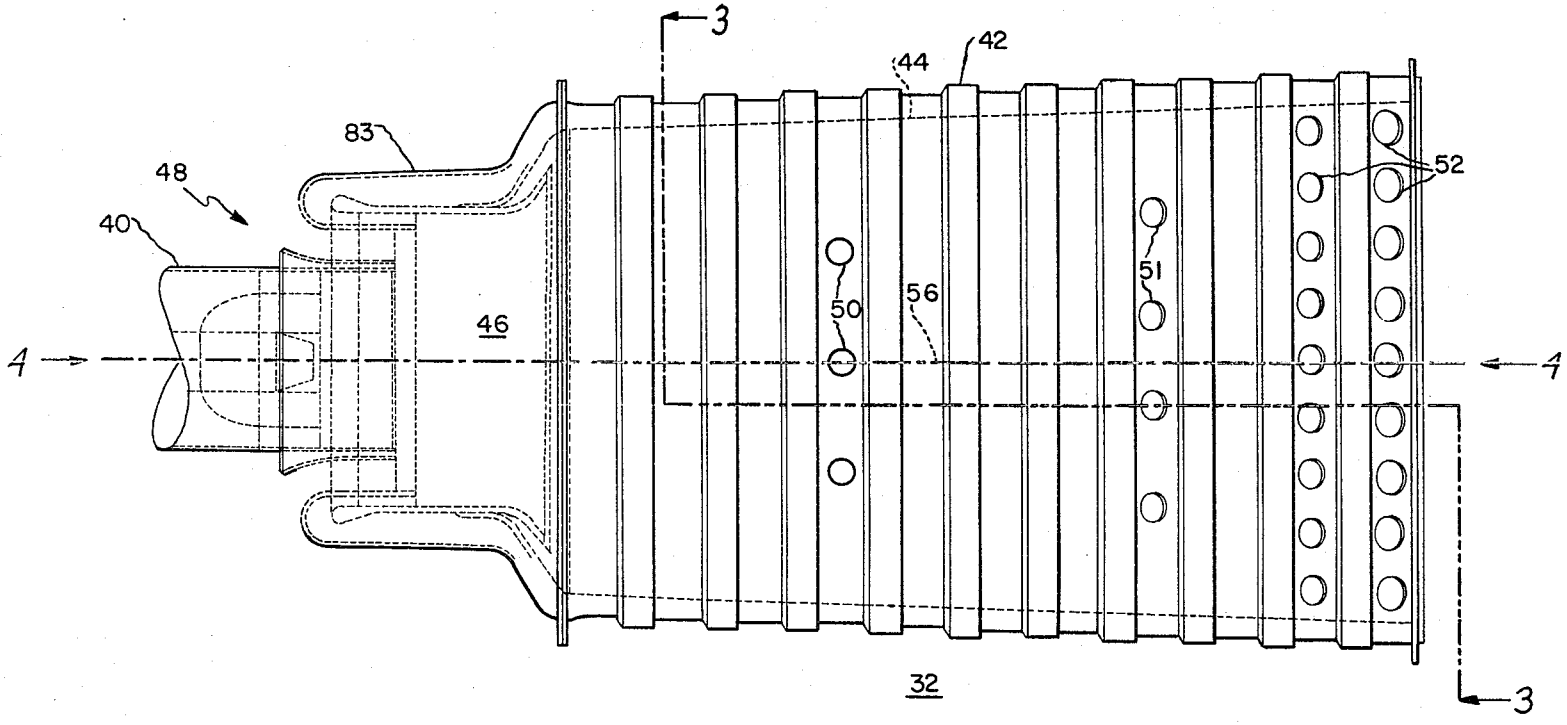
FIG. 2 is a plan view of the combustion chamber of FIG. 1.

Combustion chamber 32 is shown in greater detail in FIGS. 2–5, which present three orthogonal views of a preferred embodiment of the invention. As illustrated in the plan or top view of a combustion chamber shown in FIG. 2, combustion chamber 32 includes an outer shell wall 42 of corrugated construction which serves to carry nearly all the pressure loading during operation, and an inner liner wall 44 (shown dashed) which serves to support virtually all the thermal gardients associated with combustion. This double-wall concept effectively separates stresses due to thermal gradients from stresses due to pressure loading, thus avoiding fatigue problems normally a limiting factor in high-temperature combustor applications. Also shown in FIG. 2 are the fuel and combustion air supply system located near the upstream end 46 of combustion chamber 32 and indicated (in dashed form) generally at 48; and rows of primary and secondary dilution air holes 50 and 51 respectively and cooling air holes 52 in shell wall 42.

Figure 3:
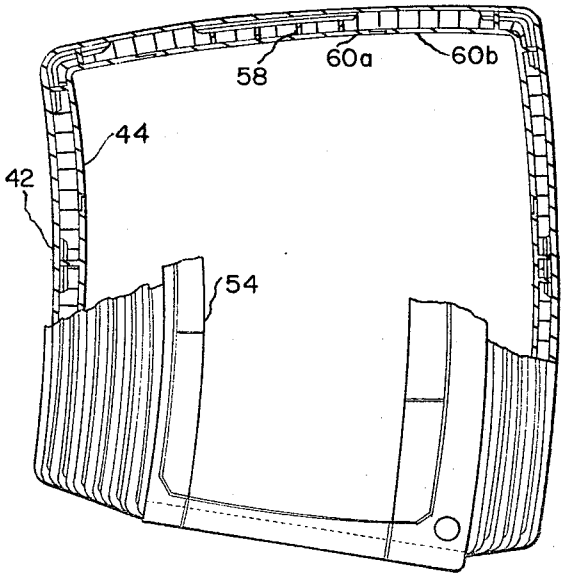
FIG. 3 is a cross-sectional view of the combustion chamber taken along the line 3—3 of FIG. 2.

The cross-sectional shape of combustion chamber 32, as illustrated in FIG. 3, a view taken along the line 3—3 of FIG. 2, is approximately that of an annular portion of a sector of a circle centered on axis 22 of gas turbine 20. The annular sectoral shape tapers from approximately a square near the upstream end 46 of combustion chamber 32 to an annular sector approximately 1/n of the total annulus of the first stage turbine nozzle 34 at the chamber downstream end 54, where n is the total number of combustion chambers. This unique annular sectoral combustor shape eliminates the need for transition sections between combustor 28 and turbine 30 as are required with conventional circular or can-type combustion chambers. This in turn permits a shorter gas turbine and it also simplifies cooling requirements since the peculiar shape of transition sections in changing from a circular or multi-circular cross section to an annular cross section, coupled with a desired combustor peak operating temperature of about 3000° F., would necessitate water cooling of the transition section, which would add complexity and degrade cycle performance. The simplicity of the annular sectoral shape as compared with the shape of a circular or can-type combustor plus transition section also facilitates analysis of flow separation problems and selection of a desirably low angle of divergence of the liner wall 44 with respect to combustion chamber axis 56 (see FIG. 2) so that flow separation and the resulting cyclic thermal stresses and momentum losses are precluded.

Figure 4:
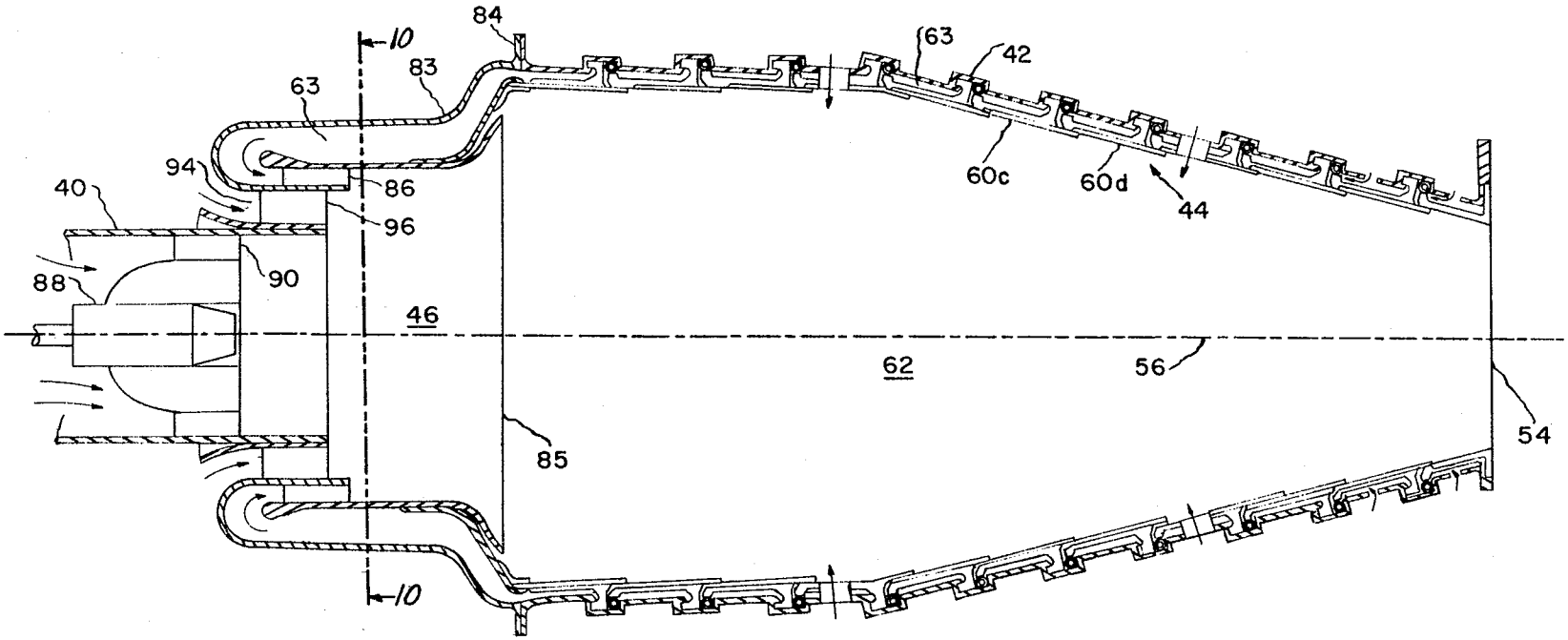
FIG. 4 is a side view of the combustion chamber taken along the line 4—4 of FIG. 2.
Figure 5:
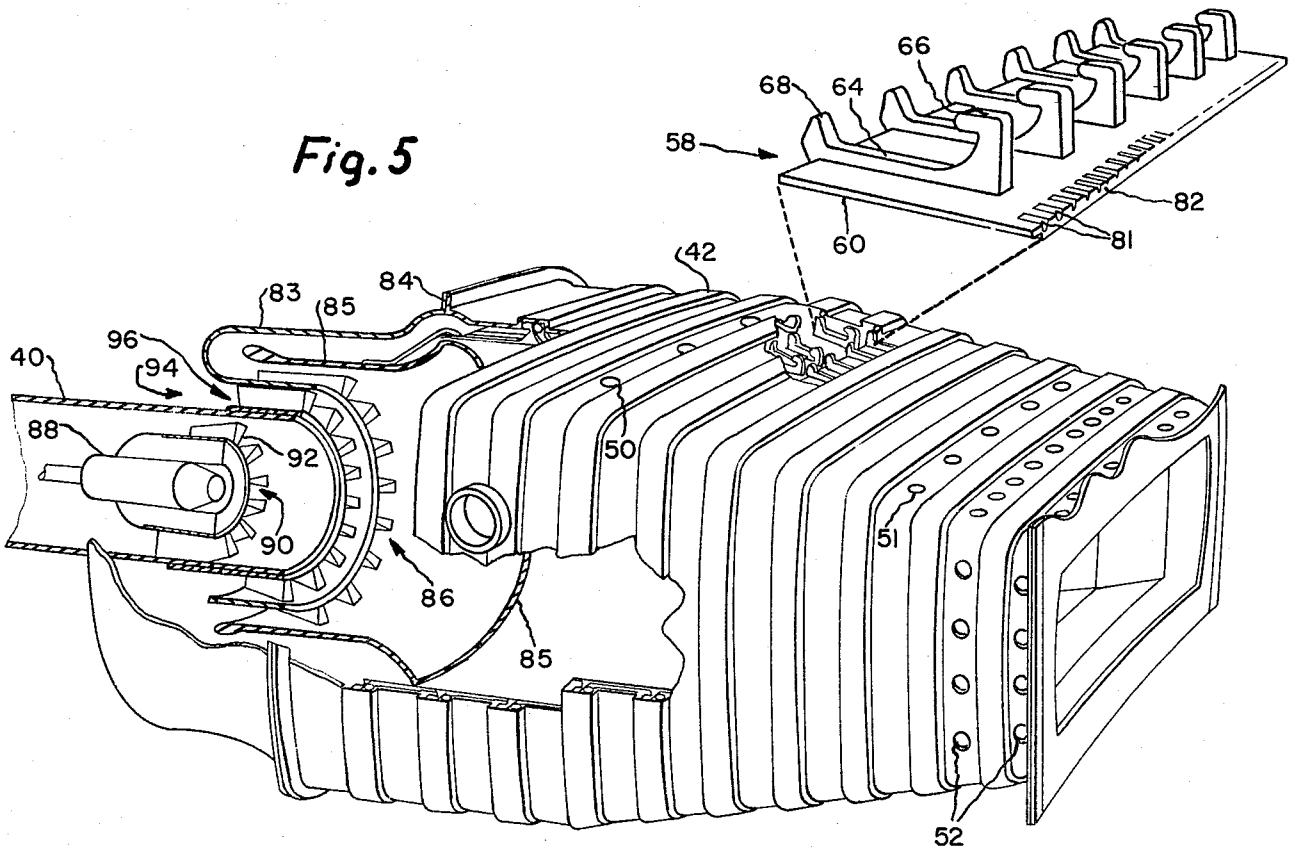
FIG. 5 is a perspective view of the combustion chamber with sections broken away to expose details of the fuel and air supply systems and also includes an exploded view of a liner panel and panel support.

The double-wall construction and fuel and air flow arrangements for combustion chamber 32 are shown in FIGS. 4 and 5, which are respectively side and perspective views of combustion chamber 32. Corrugated outer shell wall 42, preferably fabricated from a commercially available high-strength nickel-base alloy such as Inconel 718, provides the mechanical support for liner wall 44 and also supports essentially all of the pressure loading during operation of combustor 28. The corrugated construction of shell wall 42 provides high stiffness (estimated as 40 times the stiffness of a typical plate of comparable thickness) for controlling bending and vibratory stresses and also forms a groove and lip arrangement within shell wall 42 which, as shown in greater detail in FIG. 6, engages panel supports such as support 58, retaining liner wall 44. By means of cooling arrangements to be described hereinafter, shell wall 42 is operable at temperatures 500°–600° F. lower than liner wall 44 when low BTU fuel is burned, and with negligible thermal gradients between its inner and outer surfaces.

Within shell wall 42 and separated and supported therefrom by panel supports 58 is liner wall 44, which is comprised of a plurality of overlapping liner panels such as panel 60 shown in the exploded portion of FIG. 5. As shown in FIG. 3, liner wall 44 when viewed in cross section has a segmented appearance due to the interlocking of the edges of abutting liner panels such as panels 60A and 60B; as indicated in the side view of FIG. 4, the upstream and downstream ends of adjacent panels such as panels 60C and 60D overlap in a shingling or telescoping manner. During operation of gas turbine 20, liner wall 44 supports virtually all the thermal gradients which are imposed on combustion chamber 32 due to burning in combustion zone 62 within wall 44 and cooling of combustor components, and hence the panels of liner wall 44 are preferably fabricated from a high-temperature nickel-base alloy such as Udimet 500 or a cobalt-base alloy such as MAR-M509, both readily available commercially.

Figure 6:
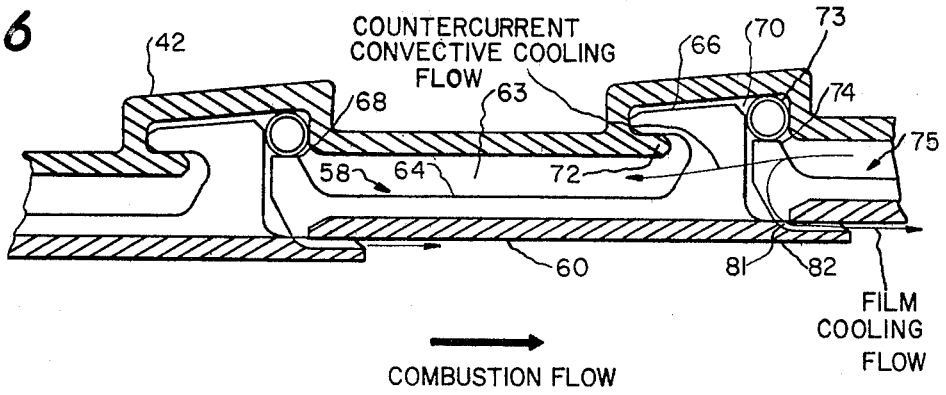
FIG. 6 is a side view of a portion of the liner wall and pressure shell showing attachment details and illustrating the directions of coolant flow and combustion flow.

The unique arrangement of supporting liner wall 44 from outer shell wall 42 is illustrated in FIGS. 3 through 6. As indicated in FIGS. 5 and 6, each liner panel such as panel 60 has rigidly attached thereto a plurality of panel supports such as support 58 which are equally spaced and aligned approximately parallel to the direction of countercurrent coolant flow in the coolant channel 63 defined between outer shell wall 42 and liner wall 44. Panel support 58 comprises an elongated rib section 64 with a hook 66 at its downstream end and a retainer support 68 at its upstream end. As best shown in FIG. 6, hook 66 is adapted to fit within groove 70 formed in corrugated shell wall 42 and to engage lip 72 of wall 42. Hook 66 is held within groove 70 by contact with retainer 73, a segmented ring of circular cross section which is inserted into groove 70 after the fitting of hook 66 therein. Retainer 73 is in turn supported within groove 70 by retainer support 74 of the adjacent downstream panel support 75. The rib section 64, in addition to connecting hook 66 and retainer support 68, adds stiffness and coolable surface area to liner panel 60, thus reducing peak panel temperatures, temperature gradients, and stresses as well as guiding coolant flow within channel 63.

Figure 7:
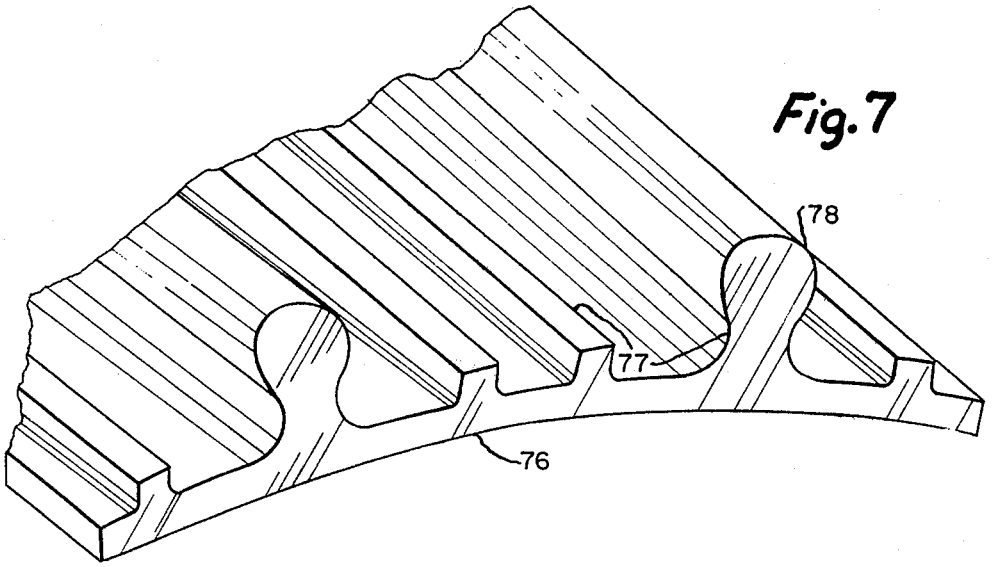
FIG. 7 is a perspective view of a portion of a modified liner panel.
Figure 8:
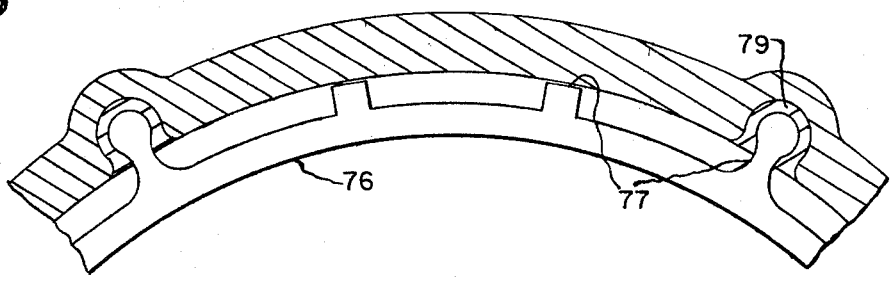
FIG. 8 is an end view of the modified liner panel of FIG. 7 showing retention of the panel within a modified outer shell wall of the combustion chamber by means of panel support bulbs.

An alternate construction given in FIGS. 7 and 8 shows a liner panel 76 which includes fins 77 formed integrally therewith, some of which have panel support bulbs 78 which provide support for panel 76 without the need for separate retainers such as retainer 73 of the FIG. 6 construction. As indicated in FIG. 8, wherein liner panel 76 is shown installed within grooves 79 of outer shell wall 80, grooves 79 are sized somewhat larger than bulbs 78 to allow for thermal growth and run generally parallel to the flow of countercurrent cooling air rather than perpendicular thereto as does a typical groove 70 defined by the outer shell wall 42 of FIGS. 1 through 6.

Both convective and film cooling systems are used to control temperatures of combustor components, and the cooling arrangements are of considerable importance with regard to achieving high combustor and cycle efficiencies and firing temperatures relatively close to the adiabatic stoichiometric temperature limit of the low-BTU coal gas employed as the primary combustor fuel. As described above, outer shell wall 42 and liner wall 44 define therebetween a coolant channel 63 to which cooling air from compressor 26 (see FIG. 1) is admissible through cooling air holes 52 in outer shell wall 42 near the downstream end of combustion chamber 32. During operation of gas turbine 20 (and now with reference to FIG. 4), coolant channel 63 accommodates a flow of air along the entire liner wall 44 in countercurrent or reverse flow relationship to the direction of flow in combustion zone 62, and the countercurrent flow convectively cools the outer surface of liner wall 44 as well as the inner surface of shell wall 42. (The effectiveness of the heat transfer is enhanced by the direction of coolant flow since for each liner panel the coolest air contacts the hottest portion (downstream end) of the panel). Each liner panel such as panel 60 of FIG. 5 includes film cooling grooves 81 in the overhang lip 82 located near its downstream end so that as the countercurrent air flows along the outer surface of liner wall 44, a portion of it turns 180° and passes through grooves 81 near the region of overlap of the adjacent downstream panel and then flows along the inner (hot gas) surface of the downstream panel for film cooling thereof. Near the upstream end 46 of combustion chamber 32, duct wall 83, which is attached to outer shell wall 42 as by flanged connection 84, includes a U-shaped portion which defines, together with swirl cup 85, a U-shaped section of channel 83 for turning the remaining countercurrent air 180° and directing air, now preheated, through preheated air swirler 86 and into combustion zone 62.

This combination of convective and film cooling provides high efficiency because all of the coolant is admitted to the combustion zone and thus retuns virtually all of the heat loss of liner wall 44 to the combustion zone. Moreover, since the air admitted to combustion zone 62 through swirler 86 has been preheated in its countercurrent flow over liner wall 44, fuel/air mixing and ignition are enhanced, flammability limits are broadened, combustion stability is improved, and reaction completion time is decreased.

Figure 9:
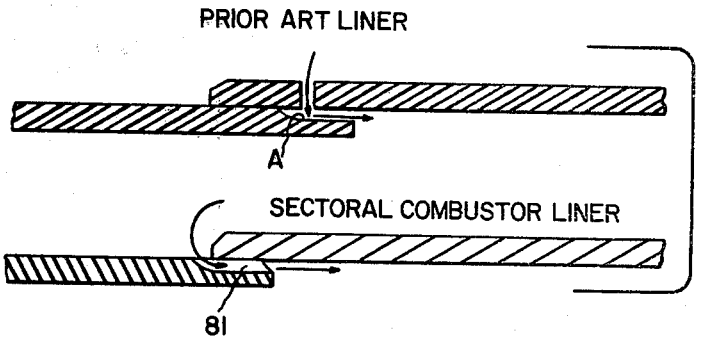
FIG. 9 is a view of a portion of a liner wall showing a prior art liner cooling scheme and a preferred film cooling arrangement according to the present invention.

The film cooling grooves 81 provide a unique arrangement for directing air from coolant channel 63 along the overhang lip 82 in an uninterrupted layer for film cooling of the inner surface of the adjacent downstream liner panel. Grooves 81 reduce the severe thermal gradients and hence high stresses encountered in prior art impingement-cooled combustor liners (see FIG. 9). In these prior art designs, overcooling of the lip at the point of coolant impingement (point A) can occur, resulting in local curling and warping of the lip; spacers, dimples, and other mechanisms added to the lip to alleviate this problem interrupt the coolant flow and decrease its overall effectiveness. By comparison the grooves 81 of the present invention yield lower heat transfer coefficients and hence reduced temperature gradients due to the smooth uninterrupted flow in the lip region, but maintain adequate net panel heat flux (and hence avoid excessive lip temperatures) by providing a local increase of surface area in the lip region of each liner panel. Grooves 81 also improve convective heat transfer between the countercurrent flow in channel 63 and the outer surface of the liner panels by washing from the panels in a region near grooves 81 a boundary layer which would otherwise shield the panels from effective cooling.

To deliver fuel for burning in combustion zone 62, combustion chamber 32 includes in the preferred embodiment illustrated in FIGS. 1–5 a single fuel pipe 40, preferably of circular cross section and concentric with chamber axis 56. Fuel pipe 40 is adapted to supply low-BTU coal gas to combustion zone 62 and also to support the upstream end of chamber 32 against radial and transverse loads while allowing unrestrained axial movement due to thermal effects (i.e., movement in a direction parallel to combustion chamber axis 56). As is best shown in FIGS. 4 and 5, housed within fuel pipe 40 and also concentric with chamber axis 56 is liquid fuel nozzle 88, which is operable to furnish a flow of liquid fuel sucn as No. 2 distillate fuel oil to combustion zone 62 during startup and low load operation of gas turbine 20. A coal gas swirler 90 is mounted on liquid fuel nozzle 88 and includes means such as swirl vanes 92 for imparting swirl to the coal gas for enhanced mixing and combustion of coal gas and air. To provide an adequate supply of swirling combustion air to combustion zone 62, the U-shaped portion of duct wall 83 is spaced outwardly from fuel pipe 40 to define therebetween primary air passage 94, and a primary air swirler 96 is also positioned between fuel pipe 40 and the duct wall U-shaped portion.

Figure 10:
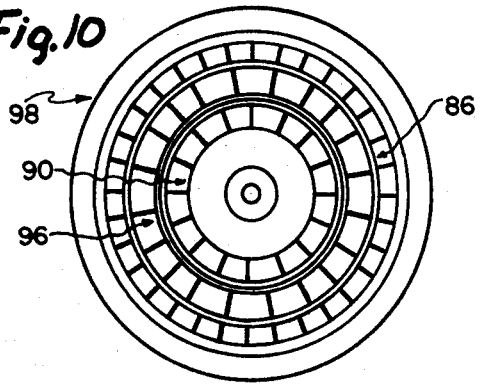
FIG. 10 is a cross-sectional view showing details of a fuel and combustion air supply system of the combustion chamber along the line 10—10 of FIG. 4.
Figure 11:
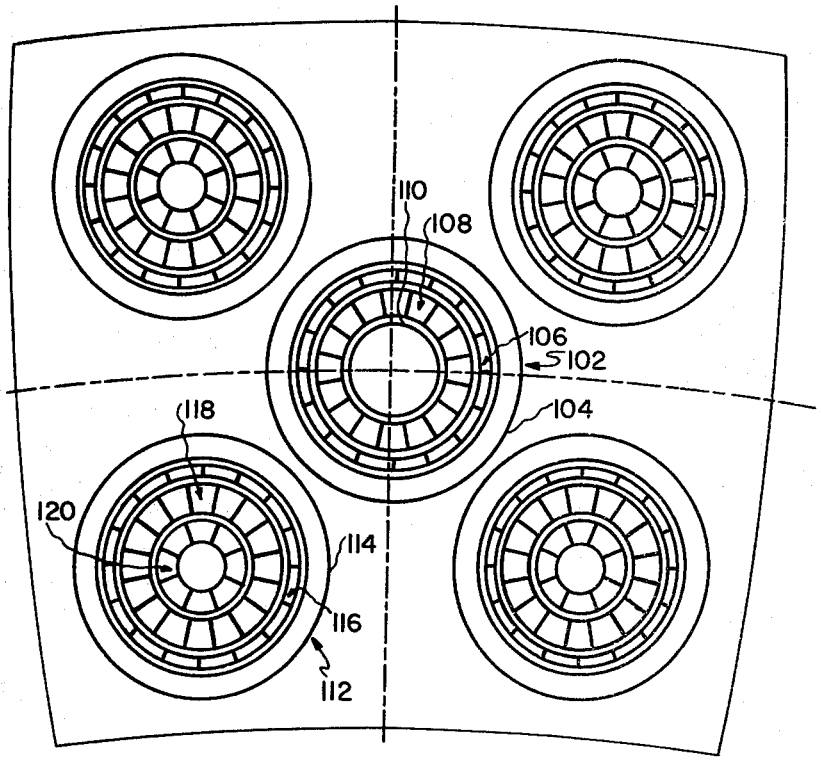
FIG. 11 is a cross-sectional view of a modified fuel and combustion air supply system wherein several nozzle assemblies are used in place of the single assembly of FIG. 10.

A cross-sectional view of the fuel and combustion air supply system of combustion chamber 32 as taken along the line 10—10 of FIG. 4 is given in FIG. 10. To provide good mixing of coal gas and air, yet avoid viscous losses from mixing counter-rotating air layers, preheated air swirler 86 and primary air swirler 96 are adapted to cause swirl of air in the same direction but opposite to the direction of swirl imparted to the coal gas by coal gas swirler 90. A modified system is shown in FIG. 11 wherein instead of the single nozzle assembly 98 of FIG. 10, five nozzle assemblies are provided. This permits, at the expense of some added complexity, use of swirl cups of smaller diameter than the rather large swirl cup 85 of the single nozzle assembly configuration, thus reducing the risk of potentially damaging combustion-driven pressure pulsations. As shown in FIG. 11, central nozzle assembly 102 includes within swirl cup 104 a coal gas swirler 106, primary air swirler 108, and liquid fuel nozzle 110. For simplicity, no provision is made for passing preheated air through nozzle assembly 102. The four matched outer nozzle assemblies such as assembly 112 each include a swirl cup 114, and in annuli of decreasing radii, preheated air swirler 116, primary air swirler 118 and coal gas swirler 120.

Figure 12:
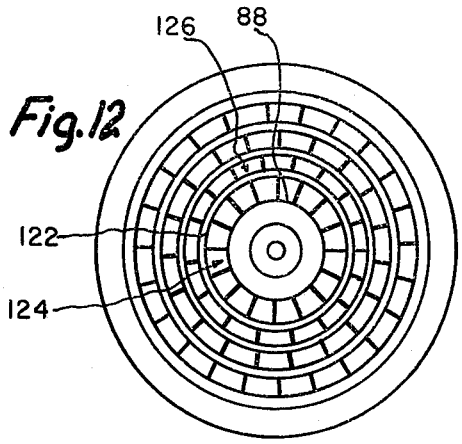
FIG. 12 is a cross-sectional view of a fuel and air supply system similar to that of FIG. 10 except including an additional air swirler.

The placement of coal gas swirler 106 near the outside of central nozzle assembly 102 and coal gas swirler 120 near the center of outer nozzle assembly 112 avoids having a layer of coal gas near liner wall 42 during operation and also provides efficient mixing of coal gas and air since, upon emergence from the respective swirlers, coal gas is sheared only by air and thus fluid momentum exchanges are used primarily in mixing fuel and air, not in mixing fuel with fuel. The placement of primary air swirler 108 of central nozzle assembly 102 between liquid fuel nozzle 110 and coal gas swirler 106 is also important in allowing a smooth transition from low-load operation wherein liquid fuel alone is burned to operation at higher loads (e.g., above 20 percent of design point load) wherein coal gas alone is burned. This is true because during the transition period both liquid fuel and coal gas are supplied through central nozzle assembly 102 and unless air is provided between these fuels the flame may blow out for lack of oxygen. For the same reason the nozzle assembly configuration of FIG. 10 may be modified to provide, as shown in FIG. 12, a swirl ring 122 and additional primary air swirler 124 between liquid fuel nozzle 88 and coal gas swirler 126.

Operation of combustion chamber 32 can be readily understood from the following description taken in connection with FIGS. 1 and 4. During startup and operation at low power (e.g., at less than 20 percent of design load) liquid fuel such as No. 2 distillate fuel oil is supplied to combustion zone 62 through liquid fuel nozzle 88. High-pressure air from compressor 26 enters combustion chamber 32 through primary air swirler 94, through cooling air holes 52 near the downstream end of outer shell wall 42, and preferably also through coal gas swirler 90. At low power, no coal gas is supplied through fuel pipe 40 for reasons of stability and because an adequate supply of high quality coal gas may not be available if gas turbine 20 is part of an integrated coal gasification and gas turbine/steam turbine system. As power is increased beyond, for example, 20 percent of design load, coal gas is furnished through fuel pipe 40 instead of air and the flow of liquid fuel is gradually reduced to zero. Cooling air which enters holes 52 flows along coolant channel 63 between outer shell wall 42 and liner wall 44 in reverse direction to the flow in combustion zone 62, cooling these walls and in turn being preheated. A portion of the cooling air, for example a total amount equal to two-thirds thereof, is turned 180 degrees and passes through film cooling grooves 81 (FIGS. 5 and 6) near the downstream end of each liner panel such as panel 60 and provides film cooling of the hot inner surface of the liner panels. The remaining countercurrent cooling air in channel 63 is turned 180 degrees by duct wall 83 near the upstream end 46 of the combustion chamber and passes through preheated air swirler 86 into combustion zone 62. As the mixture of swirling air and fuel burns within combustion zone 62 and flows toward the downstream end 54 of combustion chamber 32, primary and secondary dilution air enter combustion zone 62 through holes 50 and 51 respectively, the dilution air helping to control the rate of burning and the combustion chamber exit temperature profile and also aspirating a portion of the film cooling air so that it both film-cools and enters into the combustion reaction. After reaching the downstream end of chamber 32 and attaining design load temperatures of 2600°–3000° F., the diluted combustion products flow through turbine 30 wherein energy is extracted therefrom to drive compressor 26 and a suitable load. Because residence time at high temperature is minimized and the stoichiometric flame temperature of the low-BTU coal gas is much lower than for high-BTU natural gas or liquid fuels, these combustion products contain low amounts of "Thermal $NO_x$", i.e., oxides of nitrogen formed from nitrogen in the combustion air, but somewhat higher levels of $NO_x$ from conversion of fuel-bound nitrogen if appreciable quantities of ammonia are present in the coal gas.

In summary, a low-BTU coal gas-fired combustor for a high-temperature gas turbine has been described which includes separately removable combustion chambers having the following combination of unique features:

sectoral annular shape to contain the combustion process without requiring a transition section upstream of the turbine, thus permitting simple cooling arrangements and a short, easily supported rotor and avoiding flow separation;

double-wall construction to separate pressure stresses from thermal stresses;

combustion chamber and cooling system arrangement permitting a fully air-cooled combustor, with no parasitic externally supplied coolant;

reverse flow convective cooling between inner and outer walls, with all coolant admitted to the combustion zone, thus returning virtually all of the wall heat loss to the combustion process, making it a highly efficient, essentially adiabatic process;

corrugated outer shell wall to provide high stiffness and facilitate support of liner panels;

preheating of a portion of the reaction oxidant by fluidly connecting the reverse flow coolant channel to the upstream end of the combustion chamber, thus improving ignition, flammability limits, and stability, and decreasing reaction time;

liner panels with film cooling grooves which preclude locally severe lip thermal stresses and improve boundary layer washoff while film cooling the inside liner panel surfaces; and ribbed liner panel supports which lower panel temperatures and stiffen the panels.

While there has been shown and described what is considered a preferred embodiment of the invention, it is understood that various other modifications may be made therein, and it is intended to claim all such modifications which fall within the true spirit and scope of the present invention.

What is claimed is:

1. A combustion chamber operable to burn low-BTU fuel gas in a gas turbine comprising:

an outer shell wall of corrugated construction;

a liner wall comprising a plurality of liner panels each having an upstream end supported in overlapping relationship with the downstream end of an adjacent liner panel, said liner wall housed coaxially within said shell wall and having an outer surface and an inner surface, said shell wall and said liner wall each having a cross section of a shape substantially equal to an annular sector of said gas turbine;

said liner wall defining internally thereof a combustion zone and further defining between said liner wall and said shell wall a coolant channel for the flow of air in countercurrent relationship to flow in said combustion zone for cooling said liner wall outer surface;

liner attachment means for supporting said liner wall from said shell wall said liner attachment means including a plurality of panel supports comprising an elongated rib or bulb rigidly attached to said inner wall and aligned approximately parallel to the direction of the countercurrent coolant flow in said coolant channel;

air supply means for introducing combustion air to said combustion zone; and fuel supply means for introducing fuel gas and liquid fuel to said combustion zone.

2. The combustion chamber of claim 1 wherein said liner panel downstream end includes film cooling grooves for permitting a portion of said countercurrent flow of air to turn approximately 180 degrees and pass through said liner wall near the region of panel overlap for film cooling of said liner wall inner surface.

3. A combustion chamber operable to burn low-BTU fuel gas in a gas turbine comprising:

an outer shell wall of corrugated construction;

a liner wall comprising a plurality of liner panels each having an upstream end supported in overlapping relationship with the downstream end of an adjacent liner panel, said liner wall housed coaxially within said shell wall and having an outer surface and an inner surface, said shell wall and said liner wall each having a cross section of a shape substantially equal to an annular sector of said gas turbine;

said liner wall defining internally thereof a combustion zone and further defining between said liner wall and said shell wall a coolant channel for the flow of air in countercurrent relationship to flow in said combustion zone for cooling said liner wall outer surface;

said liner panel downstream end including film cooling grooves for permitting a portion of said countercurrent flow of air to turn approximately 180 degrees and pass through said liner wall near the region of panel overlap for film cooling of said liner wall inner surface;

said outer shell wall of corrugated construction forming within said wall opposite each of said liner panels a groove and a lip for receivably retaining said liner attachment means, said groove and said lip extending generally peripherally around an annular sectoral cross section of said shell wall;

liner attachment means for supporting said liner wall from said shell wall;

air supply means for introducing combustion air to said combustion zone; and fuel supply means for introducing fuel gas and liquid fuel to said combustion zone.

4. The combustion chamber of claim 3 wherein said liner attachment means comprises panel supports and a segmented retainer for each of said liner panels, each of said panel supports including a rib section attached to a liner panel and having a hook at its downstream end for engaging said lip and a retainer support at its upstream end, said segmented retainer being receivable in said groove to lock said hook therein and said retainer in turn being supportable within said groove by the retainer support of the adjacent downstream panel support.

5. A combustion chamber as in claim 1 further having an upstream end, a downstream end, and an axis, and wherein said fuel supply means comprises:

a fuel pipe concentric about said axis and positioned near said upstream end;

a liquid fuel nozzle housed within and spaced from said pipe and defining a coal gas passage therebetween; and a coal gas swirler disposed between said liquid fuel nozzle and said fuel pipe.

6. A combustion chamber operable to burn low-BTU fuel gas in a gas turbine, said combustion chamber having an upstream end, a downstream end and an axis, and further comprising:

an outer shell wall of corrugated construction;

a liner wall comprising a plurality of liner panels each having an upstream end supported in overlapping relationship with the downstream end of an adjacent liner panel, said liner wall housed coaxially within said shell wall and having an outer surface and an inner surface, said shell wall and said liner wall each having a cross section of a shape substantially equal to an annular sector of said gas turbine;

said liner wall defining internally thereof a combustion zone and further defining between said liner wall and said shell wall a coolant channel for the flow of air in countercurrent relationship to flow in said combustion zone for cooling said liner wall outer surface;

liner attachment means for supporting said liner wall from said shell wall;

air supply means for introducing combustion air to said combustion zone;

said air supply means comprising a duct wall attached to said outer shell wall near said combustion chamber upstream end and including a U-shaped portion; and, a swirl cup housed generally within and spaced from said duct wall U-shaped portion to define therewith a U-shaped section of said coolant channel in which said countercurrent flow may be turned 180 degrees and directed into said combustion zone as preheated combustion air; and wherein said duct wall U-shaped portion and said fuel pipe define therebetween a primary air passage through which primary combustion air may be introduced into said combustion zone, and fuel supply means for introducing fuel gas and liquid fuel to said combustion zone, said fuel supply means comprising a fuel pipe concentric about said axis and positioned near said upstream end, a liquid fuel nozzle housed within and spaced from said pipe and defining a coal gas passage therebetween, and a coal gas swirler disposed between said liquid fuel nozzle and said fuel pipe.

7. The combustion chamber of claim 6 further including a preheated air swirler supported between said swirl cup and said duct wall U-shaped portion, and a primary air swirler supported between said duct wall U-shaped portion and said fuel pipe.

8. The combustion chamber of claim 7 further including a swirl ring positioned between said liquid fuel nozzle and said coal gas swirler to define a primary air passage between said liquid fuel nozzle and said swirl ring.

9. The combustion chamber of claim 1 wherein said air supply means and said fuel supply means comprise:

a central nozzle assembly positioned near the axis of said combustion chamber and adapted to supply liquid fuel, coal gas, and primary combustion air to said combustion zone; and a plurality of matched outer nozzle assemblies spaced from said central nozzle assembly and adapted to supply coal gas, primary combustion air, and preheated secondary combustion air to said combustion zone.

10. The combustion chamber of claim 9 wherein said central nozzle assembly and said outer nozzle assemblies include air swirlers and coal gas swirlers arranged such that liquid fuel and coal gas, upon emergence from said fuel supply means, are sheared by air only and not by an adjacent stream of liquid fuel or coal gas.

11. The combustion chamber of claim 2 wherein said outer shell wall includes grooves oriented generally parallel to the direction of said countercurrent flow and said liner attachment means comprises fins formed integrally with said liner panels and having panel support bulbs receivable within said grooves.

* * * * *